United States Patent [19]

Schmidt et al.

[11] 3,979,855

[45] Sept. 14, 1976

[54] CONSTRUCTION TOY

[76] Inventors: Otto Schmidt, 16 Schwindstr.; Ulrich Supprian, 18 Schwindstr., both of Hamburg 52, Germany, 2000; Franz T. Villinger, 16 Hohenstaufenstr., Boertlingen, Germany, 7321

[22] Filed: Mar. 12, 1975

[21] Appl. No.: 557,778

Related U.S. Application Data

[63] Continuation-in-part of Ser. No. 476,954, June 6, 1974, abandoned.

[30] Foreign Application Priority Data

June 16, 1973 Germany ..... 2330755

[52] U.S. Cl. ..... 46/29; 46/28

[51] Int. Cl.[2] ..... A63H 33/10

[58] Field of Search ..... 46/29, 28, 26

[56] References Cited

UNITED STATES PATENTS

| | | | |
|---|---|---|---|
| 1,860,627 | 5/1932 | Sherman | 46/29 |
| 3,699,709 | 10/1972 | Schmidt | 46/29 |

FOREIGN PATENTS OR APPLICATIONS

| | | | |
|---|---|---|---|
| 229,861 | 8/1960 | Australia | 46/26 |
| 1,183,331 | 1/1959 | France | 46/28 |
| 1,491,466 | 1/1967 | France | 46/28 |
| 415,250 | 8/1934 | United Kingdom | 46/29 |
| 383,585 | 11/1932 | United Kingdom | 46/29 |

*Primary Examiner*—F. Barry Shay
*Attorney, Agent, or Firm*—Martin A. Farber

[57] ABSTRACT

A construction toy comprising a plurality of flat members constituting flat bars and/or assembly members formed with openings therein. Separate coupling means are provided for coupling the members and include resilient protrusions releasably engaging in the openings of the members to be coupled. The members are formed with surface recesses in the flat sides arranged axially symmetrically with respect to the openings, and the coupling means includes projections complementary in shape to that of the surface recesses and which engage therein when the members are coupled by the coupling means, the projections constituting at least two pins complementary in arrangement to that of the surface recesses. Slots equal in width to the thickness of the members are provided in the edges, and the edges are beveled and define edge recesses therebetween.

11 Claims, 12 Drawing Figures

FIG. 10
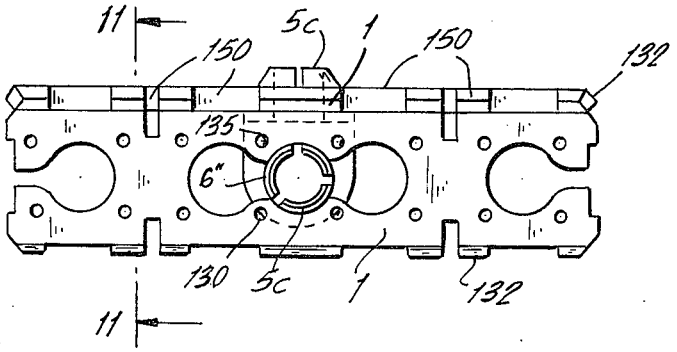
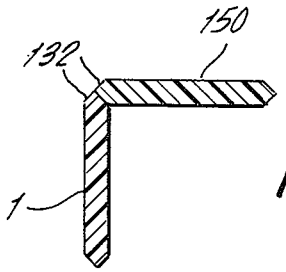
FIG. 11
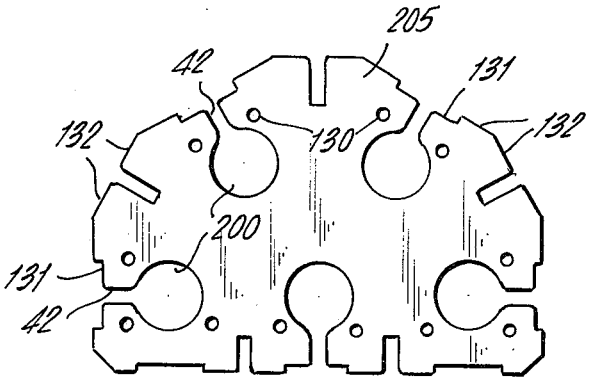
FIG. 12

CONSTRUCTION TOY

The present invention is a continuation-in-part application to our copending patent application Ser. No. 476,954 filed on June 6, 1974, now abondoned.

The present invention is an improvement to U.S. Pat. No. 3,699,709 issued on Oct. 24, 1972.

The present invention relates to a construction toy, comprising flat bars and/or assembly pieces (herein, both called members) having substantially perpendicularly extending slots (2) along the longitudinal edges and having openings (3,4) as well as coupling elements (5) which resiliently engage in the openings. In this construction toy the flat bars and assembly pieces are provided with edge limitations extending perpendicularly to the surfaces.

These parts provide three different possibilities for connection, namely, a connection by plugging-in members at the positions of the slots, a connection by insertion of members into the openings, and a connection in longitudinal and transverse directions by means of the coupling elements.

It is an object of the present invention to improve the connections as well as to provide additional types of connections for a constructional toy of the above-mentioned type by means of improved cooperative structural features thereof.

In accordance with the above-mentioned objective, a further development of a construction toy in accordance with the present invention substantially improves the connections by means of the coupling elements by the provision of additional surface recesses (130), and projections (135) engaging in the recesses, which are disposed on the flat bars and/or assembly pieces and the coupling elements. In this manner the connections are improved with respect to their rigidity by a precise transfer of transverse forces at the points of abutment.

It is another object of the present invention in accordance with a further development thereof to considerably increase the type and number of possible connections of the basic elements of the construction toy by providing beveled edges on the flat bars and/or assembly pieces, which edges are beveled on both sides at an angle of 45 degrees to the outer periphery, and by the addition of angle coupling elements, which cooperatively couple the flat bars and/or assembly pieces angularly to one another with cooperating complementary abutment of the respective beveled edges of the angularly connected bars and/or pieces (FIGS. 10 and 11). In this manner the flat bars and/or assembly pieces, in addition to the three basic types of connections, can also be coupled to each other abuttingly along their edge peripheries with their planes oriented angularly, and particularly perpendicularly to each other.

By this it is now possible to assemble the flat bars and/or assembly pieces so as to form, for example, angular, U-shaped and hollow profiled constructions. The cooperative abutting beveled edges in such connection in combination with the angle coupling elements additionally provide improved rigidity to the angularly connected parts; furthermore these combination features also cooperate with the above-mentioned recesses and projections of the present invention to provide still a further improved stiffness of the connected parts.

In accordance with a further object and development of the present invention, slots which extend into the openings are provided at the ends of the flat bars and/or assembly pieces. This makes possible still further connections of the flat bars and/or assembly pieces, at still other positions, by insertions through these end slots.

It is still another object of the present invention to yet further improve the basic construction toy and create further types of possible connections of the parts. This object is achieved in accordance with the invention essentially in the manner that the surface recesses in the flat bars and/or assembly pieces are formed as cylindrical depressions extending from both flat surfaces of the bars and/or assembly pieces, and preferably of a depth corresponding to less than one-half of the thickness of the bar, and the recesses are axially symmetrically disposed equidistantly about the center of the openings (3,4) in the bars and/or assembly pieces. The corresponding projections on the coupling elements are formed as, at least two cylindrical pins, correspondingly complementary in arrangement, diameter and length to that of the surface recesses in the flat bars and/or assembly pieces.

By this development the strength and rigidity of the connection joints are substantially improved when connecting flat bars and/or assembly pieces by means of the coupling elements. In this respect, a coupling element with its projection pins (135) entering the surface recesses of the bar and/or assembly piece prevents the slit ends (which ends are separated by and are adjacent to the above-mentioned end slot 40) from bending apart (FIGS. 2 and 4), since the coupling element bridges over the end slot with its respective pins engaging in the surface recess in each of the adjacent slit ends of the bar and/or assembly piece. It is also possible to provide the surface recesses on the coupling elements, and the pins on the bars and/or assembly pieces; still the surface recesses may be formed completely through the bars and/or assembly pieces.

Another advantageous development and object of the present invention is the formation of the flat bars and/or assembly pieces with edge recesses (131) adjacent the circular openings (3,4) which edge recesses have a depth corresponding to half the thickness of the bars and/or assembly pieces and a length equal to half the width of the bars. By such a formation of the edge recesses, one can connect the flat bars to each other and/or to the assembly pieces, additionally, at places provided with slots (2,2') on opposite longitudinal sides of a bar (which slots were normally heretofore used for plug-in connections of the parts), in planes which lie perpendicular to each other, by means of angle coupling elements (FIGS. 2, 3, 5). The beveled edges (132), which define therebetween an adjacent edge recess of one member, transversely enter into the two aligned opposite slots of another member, with the beveled edges cooperatively abutting the inner ends of the aligned slots of the other member, and with the face of the edge recess flushly abutting the flat surface of the other member. Thus there is offered substantial rigidity for this type of connection.

With these and other objects in view which will become apparent in the following detailed description, the present invention will be clearly understood in connection with the accompanying drawings, in which:

FIG. 10 is a side view of a flat bar connected to another flat bar longitudinally parallel but perpendicular to each other;

FIG. 11 is a section taken along lines 11 —11 of FIG. 10;

FIG. 12 is a side view of an assembly piece of the invention.

Figure 5:
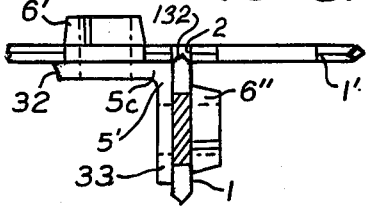
FIG. 5 is a section taken along the lines V — V of FIG. 2.
Figure 6:
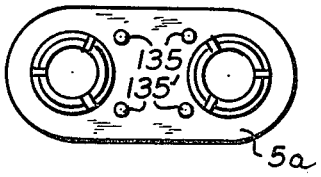
FIGS. 6 and 7 are top and front views, respectively, of a strap shaped coupling element in accordance with the present invention.

Referring now to FIGS. 1–7, a construction toy of the present invention comprises a standard flat bar 1 provided with slots 2, 2' for plug-in connections, and with circular openings 4, 4' and a central opening 3 which is circular in part, i.e., having the shape of three circles 3', 3'', 3''' which pass into each other. The diameter D of all the circular openings 3', 3'', 3''', 4, 4' are equal to a unit size A. The width B of all flat bars is 2A and the length L of the standard flat bar is 8A. The distance between the slots 2, 2' is 4A, and the width N of the slots 2 is complementarily equal to the thickness S of the flat bars, the depth of each of the slots being equal to ½A. The flat bars and the corresponding assembly pieces (herein both being called "members") are provided with peripheral edges 132 (FIGS. 4, 10) which are beveled towards both sides of the members at 45 degrees each forming a right-angled isosceles triangle in cross-section. The beveled edges 132 of both the flat bars and the assembly pieces (205 of FIG. 12) are preferably linear and offer a connection of two members by means of angular coupling members **5*c* such that the respective beveled edges 132, 132 of the two members complementarily abut each other along their length with the two members extending perpendicular to each other (e.g., FIGS. 10 and 11). The coupling elements 5*c* are in the form of angle pieces with a center strap portion 5' which is preferably bent at 90 degrees and which integrally connects the two arms 32, 33 thereof, which arms each have a protrusion 6', 6'', respectively, formed in the manner of a snap-fastener button with dimensions complementary to the openings 3', 3'', 3''', 4, 4' of the members for snap-connection therewith (FIG. 5**).

Figure 8:
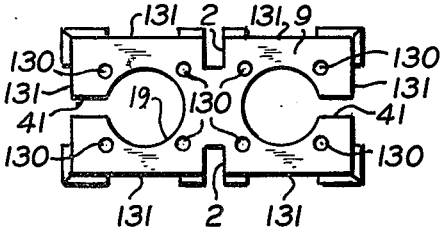
FIGS. 8 and 9 are top and front views, respectively, of a supplementary flat bar having half the length of the normal flat bar of the present invention.
Figure 7:
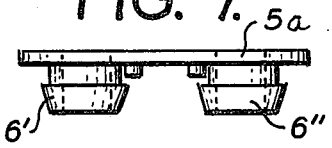
Figure 9:
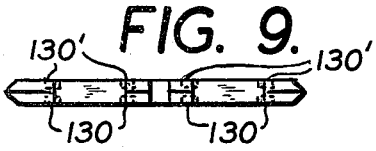

Additional end slots 40, 41, 42 are formed in the flat bars 1, 9 (FIG. 8) and in the assembly pieces 205 (FIG. 12), respectively, which slots extend from the adjacent end circular openings 4, 4', 19, 200, perpendicularly to the nearest outer peripheral edge of the member, and have a width *b* corresponding to the thickness S of the members. These end slots 40, 41, 42 make it possible to connect members to each other by insertion of a flat bar at a portion thereof along two aligned slots 2, 2 or 2', 2' on opposite longitudinal edges, into an end slot 40, 41, 42 of a second member until one of the slots 2 or 2' plugs-in to the second member at the remote portion of the adjacent circular end opening 4, 4', 19, 200 which communicates with the end slot 40, 41, 42, and then turning the flat bar in the circular end opening of the second member for a double plug-in connection (not shown but in respects similar to FIG. 5 of U.S. Pat. No. 3,699,709).

Further in another cooperative, as well as independent feature of the invention, surface recesses 130, 130' are formed in the members, constituting cylindrical depressions, extending inwardly from both flat surfaces of the members. The recesses 130, 130' are located with axial symmetry about the center point of each opening 3', 3'', 3''', 4, 4', 19, 200 at an equal radial distance therefrom at the corners of an imaginary square. Corresponding projections 135, 135' are formed on the coupling elements **5*a*, 5*c*, (as well as for example on the coupling element shown in FIG. 4 of U.S. Pat. No. 3,699,709), constituting at least two cylindrical pins 135, 135' which are complementarily adapted to the recesses 130, 130' in the members with respect to location, diameter and length or depth. The recesses 130, 130' and the cooperatively complementary projections 135, 135', in complementary projections 135, 135', in particular, substantially contribute to a stiffening of the connections of the members by the coupling members, in the manner that, for example, the strap portions 5*a*', 5' of the coupling elements 5*a*, 5*c*, respectively, bridge over the end slots 40, 41, 42 (e.g., as shown in the right hand portion of FIG. 2, and FIG. 4), upon insertion of a protrusion 6, 6' into the circular end opening 4, 4', 19, 200 communicating with the end slot 40, 41, 42 with the projections 135, 135' entering the corresponding recesses 130, 130', respectively, of the member 1, 19, 205. In this manner there is prevented any substantial elastic deformation due to forces acting on the joint connection. Further for example the complementary engagement of the projections 135, 135' in the recesses 130, 130'** strengthens the parts forming the joint connections in further cooperation with the other complementary connection rigidizing features of the members.

Figure 1:
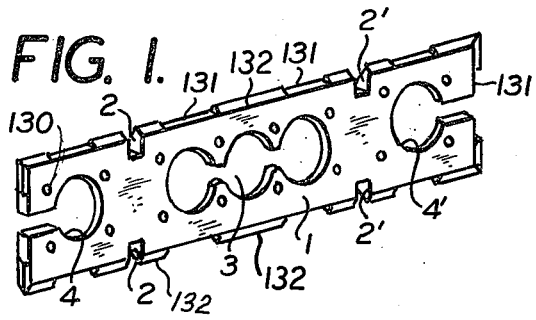
FIG. 1 is a perspective view of a normal flat bar of the present invention.
Figure 2:
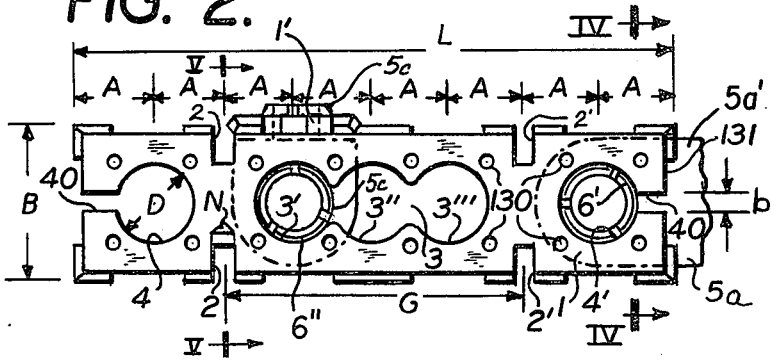
FIG. 2 is a side view of the same flat bar with another flat bar connected crossing thereto at right angles by an angle coupling element.
Figure 4:
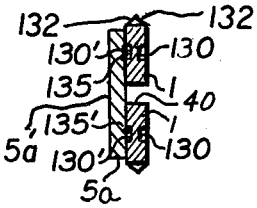
FIG. 4 is a section taken along the lines IV — IV of FIG. 2.
Figure 3:
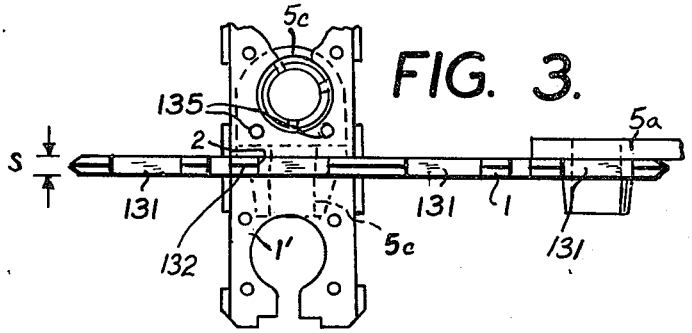
FIG. 3 is a top view of FIG. 2.

At the same time the change over the prior art structure (as in U.S. Pat. No. 3,699,709) by providing surfaces recesses and projections of the present invention which serve for the additional connection to the flat bars and/or assembly pieces, as well as the change over the prior art of the corresponding coupling elements (from the edges of the prior art into the surfaces of the parts of the present invention), makes it possible in accordance with the present invention in the case of the members, to form peripheral portions having edge recesses 131, 131' adjacent to the circular openings 3, 4, 19, 200 with a depth corresponding to half the thickness S of the members and a length corresponding to half the width of a flat bar. The edge recesses 131 are aligned with the adjacent openings 3, 4, 19, 200, such that a perpendicular bisector of an edge recess passes through the center point of the adjacent opening. In this manner there is provided additional possible connections, for example, connections by means of the angle coupling elements **5*c* of crossing flat members as indicated in FIGS. 2, 3, 5, at all places provided with edge recesses 131, 131'**.

Herein although not limited thereto "assembly pieces" include the joint parts shown in FIGS. 14, 15, 16, and 17 of U.S. Pat. No. 3,699,709, incorporated herein by reference, but as improved with the features in accordance with the present invention.

While we have disclosed several embodiments of the present invention, it is to be understood that these embodiments are given by example only and not in a limiting sense.

We claim:

1. A construction toy comprising a plurality of flat members having flat sides formed with openings therein, separate coupling means for coupling said members and including resilient protrusions, releasably engaging in said openings of said members to be coupled, said members being formed with surface recesses in said flat sides arranged axially symmetrically with respect to said openings, said coupling means including projections complementary in shape to that of said surface recesses and engaging therein when said members are coupled by said coupling means, said projections constituting at least two pins complementary in arrangement to that of said surface recesses, said flat members having beveled edges, said beveled edges forming 45 degree angles with respect to said flat sides.

2. The construction toy as set forth in claim 1, wherein said coupling means constitutes an angular coupling element.

3. The construction toy as set forth in claim 1, wherein said members include flat bars having longitudinal edges formed with slots perpendicularly extending therefrom and aligned on opposite of said longitudinal edges and having a width equal to the thickness of said members, said beveled edges define edge recesses therebetween, adjacent said openings, said edge recesses having a depth equal to half the thickness of said members and a length equal to half the width of said flat bars.

4. The construction toy as set forth in claim 3, wherein said members are formed with end slots which extend from said openings perpendicularly to a closest peripheral edge thereof and have a width equal to the thickness of said flat bars.

5. The construction toy as set forth in claim 3, wherein said edge recesses are centrally aligned with respect to an adjacent of said openings and have a length equal to a diameter of said adjacent openings.

6. The construction toy as set forth in claim 1, wherein said members are formed with end slots which extend from said openings perpendicularly to a closest peripheral edge thereof and have a width equal to the thickness of said members.

7. The construction toy as set forth in claim 6, wherein said openings are circular in shape and enlarged in diameter relative to the width of said end slots.

8. A construction toy comprising a plurality of flat members having flat sides formed with openings therein, separate coupling means for coupling said members and including resilient protrusions releasably engaging in said openings of said members to be coupled, said members being formed with surface recesses in said flat sides arranged axially symmetrically with respect to said openings, said coupling means including projections complementary in shape to that of said surface recesses and engaging therein when said members are coupled by said coupling means, said projections constituting at least two pins complementary in arrangement to that of said surface recesses, said coupling means constituting an angular coupling element, said flat members having beveled edges, said beveled edges forming 45 degree angles with respect to said flat sides, said members including flat bars having longitudinal edges formed with slots perpendicularly extending therefrom and aligned on opposite of said longitudinal edges and having a width equal to the thickness of said members, said beveled edges defining edge recesses therebetween, adjacent said openings, said edge recesses having a depth equal to half the thickness of said members and a length equal to half the width of said flat bars.

9. The construction toy as set forth in claim 8, wherein said members are formed with end slots which extend from said openings perpendicularly to a closest peripheral edge thereof and have a width equal to the thickness of said flat bars.

10. The construction toy as set forth in claim 8, wherein said edge recesses are centrally aligned with respect to an adjacent of said openings and have a length equal to a diameter of said adjacent openings.

11. The construction toy comprising a plurality of flat members having flat sides formed with openings therein, separate coupling means for coupling said members and including resilient protrusions releasably engaging in said openings of said members to be coupled, said members being formed with surface recesses in said flat sides arranged axially symmetrically with respect to said openings, said coupling means including projections complementary in shape to that of said surface recesses and engaging therein when said members are coupled by said coupling means, said projections constituting at least two pins complementary in arrangement to that of said surface recesses, said coupling means constituting an angular coupling element, said members including include flat bars having longitudinal edges formed with slots perpendicularly extending therefrom and aligned on opposite of said longitudinal edges and having a width equal to the thickness of said members, said flat members having edge recesses adjacent said openings, said edge recesses having a depth equal to half the thickness of said members and a length equal to half the width of said flat bars.

* * * * *

UNITED STATES PATENT AND TRADEMARK OFFICE

CERTIFICATE OF CORRECTION

PATENT NO. : 3 979 855

DATED : September 14, 1976

INVENTOR(S) : Otto Schmidt et al.

It is certified that error appears in the above-identified patent and that said Letters Patent are hereby corrected as shown below:

Claim 11, line 20:

delete "include"

Signed and Sealed this

Fifteenth Day of February 1977

[SEAL]

*Attest:*

RUTH C. MASON
*Attesting Officer*

C. MARSHALL DANN
*Commissioner of Patents and Trademarks*